US005575684A

United States Patent [19]

Uchida et al.

[11] Patent Number: 5,575,684

[45] Date of Patent: Nov. 19, 1996

[54] CONNECTOR HOUSING

[75] Inventors: Yoshinori Uchida; Toshihiro Maejima, both of Shizuoka, Japan

[73] Assignee: Yazaki Corporation, Tokyo, Japan

[21] Appl. No.: 417,960

[22] Filed: Apr. 6, 1995

[30] Foreign Application Priority Data

Apr. 8, 1994 [JP] Japan ..... 6-070740

[51] Int. Cl.[6] ..... H01R 13/40

[52] U.S. Cl. ..... 439/595

[58] Field of Search ..... 439/595, 587, 439/744, 857, 636

[56] References Cited

U.S. PATENT DOCUMENTS

| | | | |
|---|---|---|---|
| 3,808,578 | 4/1974 | Hansen | 439/595 |
| 3,982,805 | 9/1976 | Irie | 439/595 |
| 4,776,813 | 10/1988 | Wilson et al. | 439/595 |
| 5,226,839 | 7/1993 | Koumatsu et al. | 439/595 |

FOREIGN PATENT DOCUMENTS 53-31985 8/1978 Japan .

54-23665 8/1979 Japan .

*Primary Examiner*—Khiem Nguyen
*Assistant Examiner*—Yong Kim
*Attorney, Agent, or Firm*—Sughrue, Mion, Zinn, Macpeak & Seas

[57] ABSTRACT

To provide a connector housing in which the locking between an elastic lock piece and a terminal can be released without contacting a release tool with the terminal and a terminal retaining portion. A connector housing has a terminal insertion hole whose front end is in communication with a connection opening for connecting a mating terminal whereas a rear end of the terminal insertion hole is in communication with a terminal insertion opening. An elastic lock piece is provided within the terminal insertion hole in such a manner that a flexure-allowing space is formed at one side portion of the terminal insertion hole, the elastic lock piece having a terminal engagement portion for engagement with an inserted terminal. A release-purpose retaining portion for being engaged with a release tool so as to flex the elastic lock piece in a lock-releasing direction is formed on and projects from that surface of the elastic lock piece facing the flexure-allowing space.

20 Claims, 4 Drawing Sheets

CONNECTOR HOUSING

BACKGROUND OF THE INVENTION

1. Field of the Invention

This invention relates to a connector housing in which the ability of releasing the locking of a terminal is enhanced.

2. Related Art

Conventional connector housings are disclosed, for example, in Japanese Utility Model Examined Publication Nos. 53-31985 and 54-23665. FIG. 8 shows the construction of a commonly-known conventional connector housing.

A terminal 4, connected to a wire 3, is inserted in a terminal insertion hole 5 in this connector housing 1 from a rear end opening 2. An elastic lock piece 6 is provided within the terminal insertion hole 5, and extends forwardly from its rear rising portion 6*a* in such a manner that a flexure-allowing space 7 is formed on one side of this lock piece. A terminal engagement portion 8 for engagement with the terminal 4 is formed on that surface of the elastic lock piece 6 facing away from the flexure-allowing space 7, and when this terminal engagement portion 8 engages a step portion of the terminal 4, the terminal 4 is positioned between this engagement portion 8 and a stopper 9 at a front end, thereby preventing a rearward withdrawal of the terminal 4.

For removing the terminal 4 inserted and locked in the connector housing 1 as shown in this Figure, a release tool is inserted through the rear end opening 2, and a front end portion of this release tool is forced in between the terminal engagement portion 8 and the terminal 4 as indicated by arrow B in FIG. 8, and in this condition the elastic lock piece 6 is flexed toward the flexure-allowing space 7, thereby releasing the locked condition, and the terminal 4 is withdrawn.

In the conventional connector housing 1, however, when the locking between the terminal 4 and the elastic lock piece 6 is to be released, the front end of the release tool strikes directly against the terminal 4 and the terminal engagement portion 8, and therefore there is a risk that the terminal 4 and the terminal engagement portion 8 may be deformed or damaged. Particularly, such deformation and damage develop within the connector housing 1, and therefore can not be confirmed, and it has been desired to improve such a situation.

SUMMARY OF THE INVENTION

With the above problem in view, it is an object of this invention to provide a connector housing in which the locking between an elastic lock piece and a terminal can be released without contacting a release tool with the terminal and a terminal retaining portion.

According to the first aspect of the invention, there is provided a connector housing having a terminal insertion hole whose front end is in communication with a connection opening for connecting a mating terminal whereas a rear end of the terminal insertion hole is in communication with a terminal insertion opening, wherein an elastic lock piece is provided within the terminal insertion hole in such a manner that a flexure-allowing space is formed at one side portion of the terminal insertion hole, the elastic lock piece having a terminal engagement portion for engagement with an inserted terminal; CHARACTERIZED in that a release-purpose retaining portion for being engaged with a release tool so as to flex the elastic lock piece in a lock-releasing direction is formed on and projects from that surface of the elastic lock piece facing the flexure-allowing space.

According to the second aspect of the invention, the elastic lock piece can be flexed in a plane extending along a direction of insertion of the terminal, and a release tool insertion opening for the insertion of the release tool therein into is provided in a front end face of the connector housing.

According to the third aspect of the invention, the release tool insertion opening is larger in size than the connection opening for connecting the mating terminal.

According to the fourth aspect of the invention, the elastic lock piece comprises a piece which is supported at its front and rear ends, and can be flexed at its central portion, and a support portion at the front end of the elastic lock piece closes that portion of the flexure-allowing space disposed forwardly in the direction of insertion of the terminal.

In the first aspect of the invention, the release tool is engaged with the release-purpose retaining portion formed on that surface of the elastic lock piece facing the flexure-allowing space, and flexes the elastic lock piece in the lock-releasing direction, thereby releasing the locking between the terminal and the elastic lock piece.

In the second aspect of the invention, the release tool is inserted from the release tool insertion opening, and is engaged at its front end with the release-purpose retaining portion of the elastic lock piece, and then the release tool is angularly moved, using the edge of the release tool insertion opening, thereby flexing the elastic lock piece in a plane along the terminal inserting direction. Since the release tool insertion opening is provided in the front end face, the release tool can be inserted without being interfered by a wire extending rearwardly from the terminal.

In the third aspect of the invention, the release tool is prevented from being erroneously inserted into the connection opening for connecting the mating terminal.

In the fourth aspect of the invention, when the release tool is to be inserted into the release tool insertion opening provided in the front end face, there is no fear that the release tool will be erroneously inserted into the space holding the terminal, since the support portion of the elastic lock piece closes that portion of the flexure-allowing space disposed forwardly in the terminal inserting direction.

If the release-purpose retaining portion is formed on a reverse side of the elastic lock piece providing the terminal engagement portion, this portion has an increased thickness. When the elastic lock piece comprises the piece supported at its opposite ends, the terminal retaining portion is provided usually at the easily-flexible, central portion of the elastic lock piece so as to facilitate the insertion of the terminal. Therefore, when the terminal is repeatedly attached and detached, that portion of the elastic lock piece in the vicinity of the terminal retaining portion may be deformed or damaged. Similarly, when the elastic lock piece is to be flexed by the release tool engaged with the release-purpose retaining portion, the elastic lock piece may be deformed or damaged, for example by fierce gouging. In this invention, however, that portion of the elastic lock piece having these portions is increased in thickness, and therefore deformation and damage hardly occur.

DETAILED DESCRIPTION OF THE PREFERRED EMBODIMENTS

One preferred embodiment of the present invention will now be described with reference to the drawings.

Figure 1:
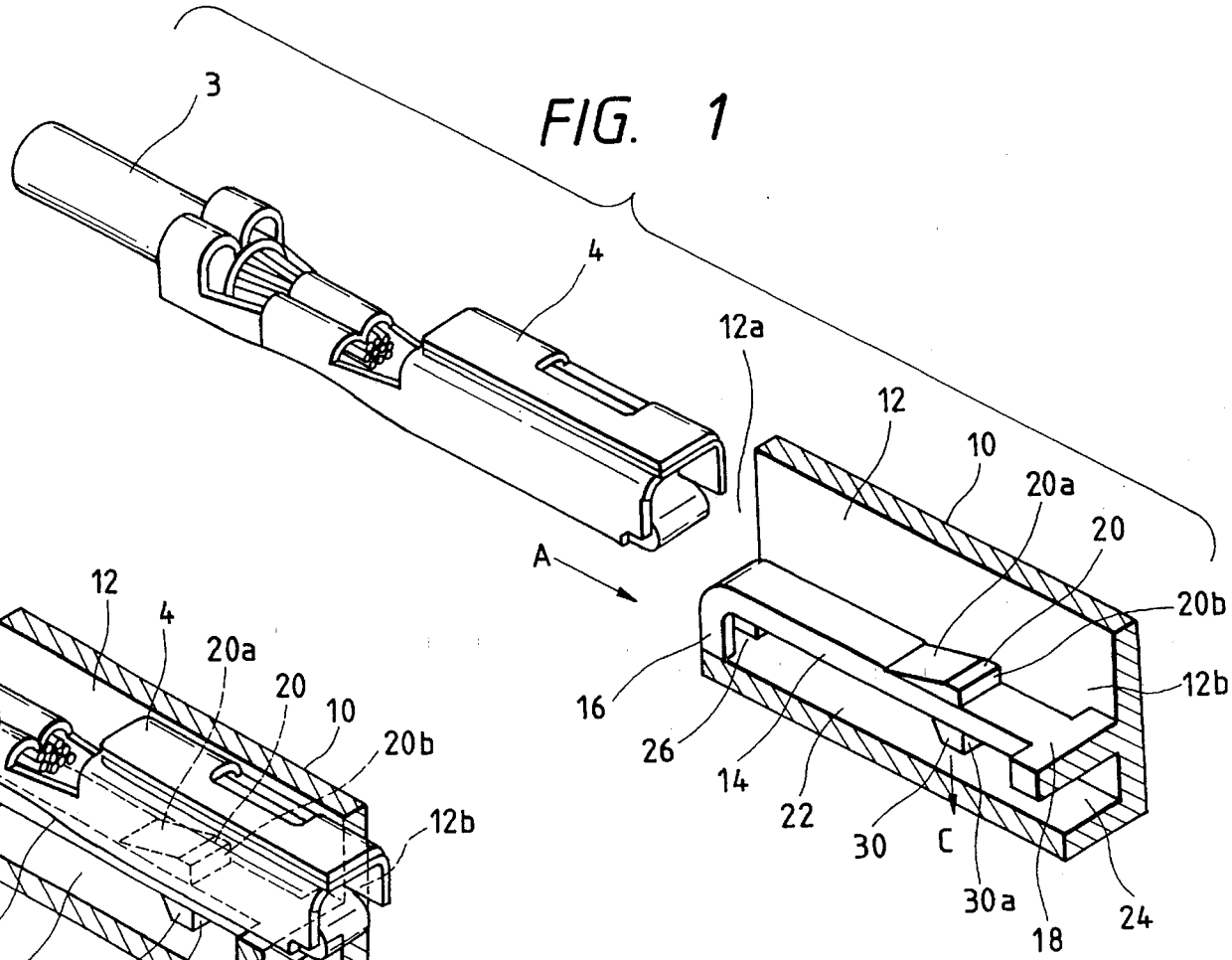
FIG. 1 is a perspective view of an important portion of a preferred embodiment of a connector housing of the present invention.
Figure 2:
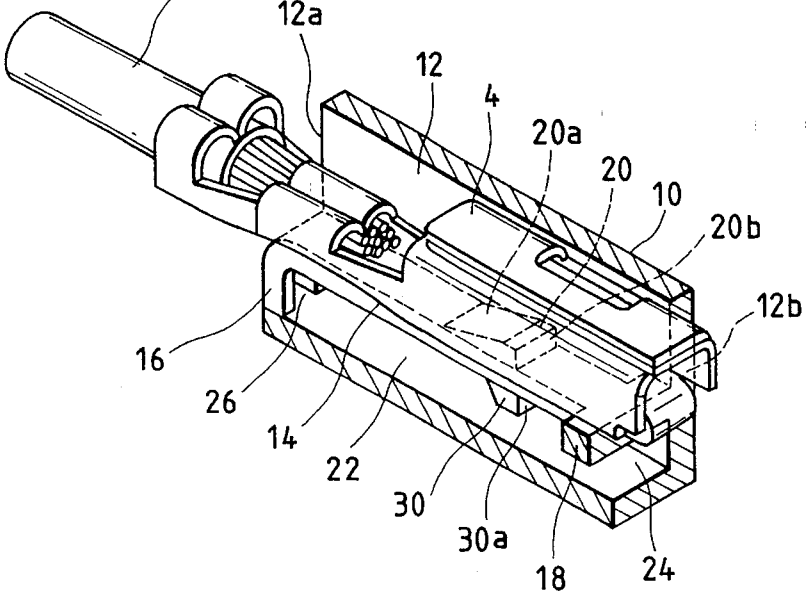
FIG. 2 is a perspective view showing a condition after a terminal is inserted into the connector housing of the above embodiment.
Figure 3:
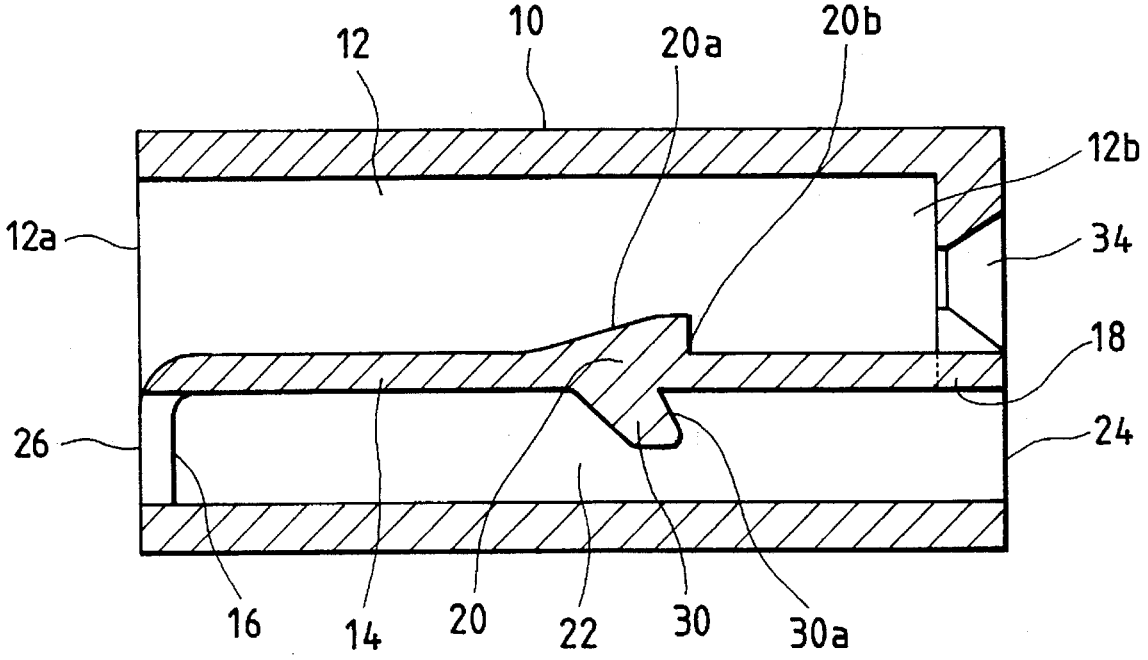
FIG. 3 is a cross-sectional view of the connector housing.
Figure 4:
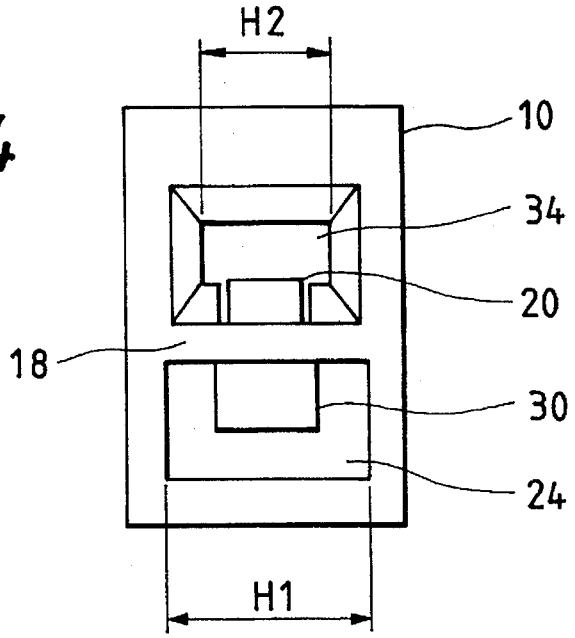
FIG. 4 is a front-elevational view of the connector housing.

FIG. 1 is a perspective view showing a condition before a terminal 4 is inserted into a connector housing 10 of this embodiment, FIG. 2 is a perspective view showing a condition after the terminal 4 is inserted into the connector housing, FIG. 3 is a cross-sectional view of the connector housing 10, and FIG. 4 is a front-elevational view of the connector housing.

A terminal insertion hole 12 is formed in the connector housing 10. As shown in FIG. 3, the terminal insertion hole 12 is open at its rear end to provide a terminal insertion opening 12*a*, and its front end 12*b* is in communication with a connection opening 34 for connecting a mating terminal. The terminal 4 is adapted to be inserted forwardly from the terminal insertion opening 12*a* at the rear end. Arrow A in the drawings indicates a direction of insertion of the terminal. The connection opening 34 has a square shape, and is tapered or outwardly flared so as to facilitate the insertion of the mating terminal thereinto. The width of this connection opening 34 is designated by H2.

An elastic lock piece 14 is provided at a lower side (in the drawings) of the terminal insertion hole 12, and is formed integrally with an inner wall of the terminal insertion hole 12. The elastic lock piece 14 has at its rear end a rising portion 16 extending from an inner bottom surface of the terminal insertion hole 12 in the forward direction. A front end portion (support portion) 18 of this elastic lock piece 14 is connected to right and left inner surfaces of the terminal insertion hole 12. Thus, the elastic lock piece 14 is supported at its opposite ends, that is, the front and rear ends. Therefore, the elastic lock piece 14 can be flexed at its central portion in a plane extending along the direction A of insertion of the terminal 4 in a direction substantially perpendicular to the inserting direction A.

The elastic lock piece 14 has a terminal engagement portion 20 for engagement with the terminal 4 which portion is formed on an upper surface of the central portion thereof in a projected manner. A flexure-allowing space 22 for the elastic lock piece 14 is provided beneath the elastic lock piece 14. The flexure-allowing space 22 is in communication with a release tool insertion opening 24 provided beneath the connection opening 34 formed in the front end of the connector housing 10 for connecting the mating terminal. The front end portion 18 of the elastic lock piece 14 is joined to the right and left inner surfaces of the terminal insertion hole 12, and therefore serves as a partition wall separating the connection opening 34 from the release tool insertion opening 24. This front end portion 18 partitions the flexure-allowing space 22 from a space in which the front end portion of the terminal 4 is to be disposed. The rising portion 16 of the elastic lock piece 14 has a mold removal hole 26.

A retaining portion 30 for release purposes is formed on and projects from that surface of the elastic lock piece 14 facing the flexure-allowing space 22. A front end of a release tool (not shown), inserted into the release tool insertion opening 24, is engageable with this retaining portion 30. This release-purpose retaining portion 30 is formed on a reverse side of the elastic lock piece 14 on which the terminal engagement portion 20 is disposed, and that portion of the elastic lock piece having these portions is increased in thickness.

The terminal engagement portion 20 has a rear surface defined by a slanting surface 20*a* slanting downwardly rearwardly, and a front surface defined by a retaining surface 20*b* extending generally perpendicularly to the terminal inserting direction. The release-purpose retaining portion 30 has a slanting front surface 30*a* projecting progressively forwardly so as to facilitate the engagement of the front end of the release tool therewith. The width H2 of the connection opening 34 for connecting the mating terminal is smaller than a width H1 of the release tool insertion opening 24 so that the release tool will not erroneously be inserted into the connection opening 34.

For inserting the terminal 4, the terminal 4 is inserted from the terminal insertion opening 12*a* at the rear end of the connector housing 10. When the front end of the terminal 4 is brought into contact with the slanting surface 20*a* of the terminal engagement portion 20 during the insertion, the central portion of the elastic lock piece 14 is pressed by the terminal 4 to be flexed toward the flexure-allowing space 22. When a step portion of the terminal 4 passes past the terminal engagement portion 20, the elastic lock piece 14 is restored, so that the terminal engagement portion 20 is engaged with the step portion of the terminal 4, thereby positioning and locking the terminal 4.

For removing the terminal 4, the front end portion of the release tool is inserted into the flexure-allowing space 22 through the release tool insertion opening 24 at the front end of the connector housing, and is brought into engagement with the release-purpose retaining portion 30 projected from the lower surface of the elastic lock piece. Then, in this condition, the release tool is angularly moved about the inner edge of the release tool insertion opening 24. As a result, the elastic lock piece 14 is easily flexed in a lock-releasing direction, thereby releasing the locked condition. Therefore, in this condition, the terminal 4 can be easily removed by withdrawing it.

In this case, since the release tool is merely inserted into the flexure-allowing space 22, there is no chance that this release tool will contact the terminal 4 and the terminal engagement portion 20, and therefore there is no chance that the release tool will deform or damage these. And besides, since the flexure-allowing space 22 and the space for receiving the terminal 4 are separated by the front end portion 18 of the elastic lock piece 14, there is no chance that the release tool will erroneously be inserted into the space holding the terminal 4. Moreover, since the release tool insertion opening 24 is provided at the front end face of the connector housing 10, the release tool can be inserted without being interfered by the wire 3 extending from the rear end of the terminal 4. Furthermore, since portion where the release-purpose retaining portion 30 and the terminal engagement portion 20 are provided is increased in thickness, there is little chance that this portion will be deformed or damaged.

Figure 5:
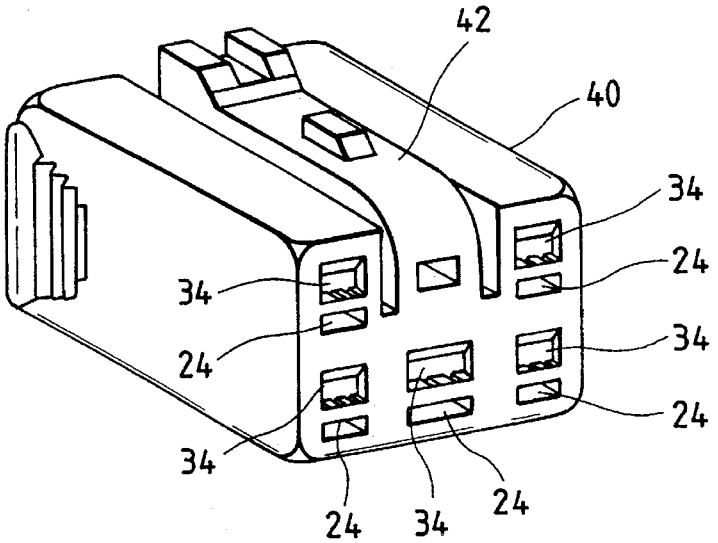
FIG. 5 is a modified for of a connector housing of the invention.

FIG. 5 shows a modified form of the above connector housing, and this connector housing 40 has an increased number of terminals. In this connector housing 40, a plurality of terminal insertion holes (not shown) are arranged in an upward-downward direction and in a right-left direction, and have an internal structure similar to that of the above-mentioned terminal insertion hole. Reference numeral 34 denotes a connection opening for connecting the mating terminal, reference numeral 24 a release tool insertion opening, and reference numeral 42 a lock arm for locking this connector relative to a mating connector.

A further embodiment of the present invention will now be described.

Figure 6:
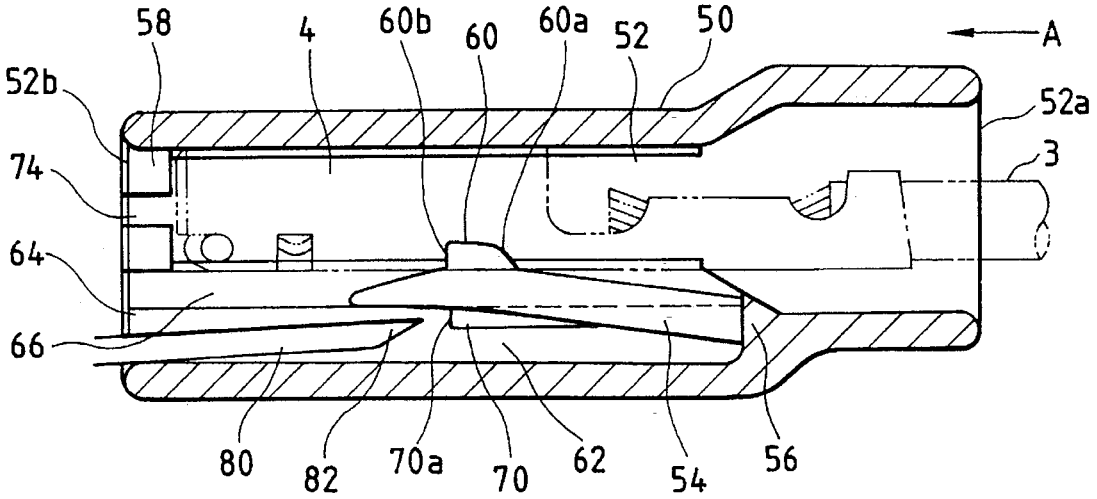
FIG. 6 is a cross-sectional view of another preferred embodiment of a connector housing of the invention in which a terminal is inserted.
Figure 7:
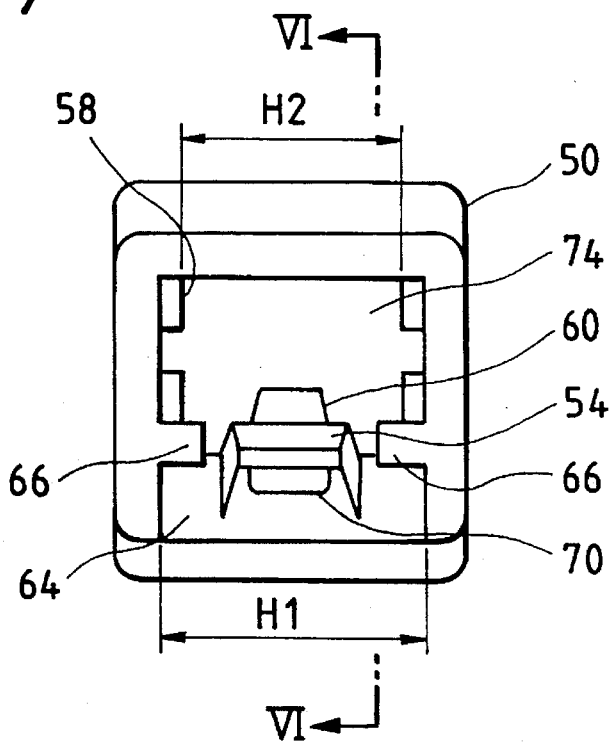
FIG. 7 is a front-elevational view of the connector housing of FIG. 6.
Figure 8:
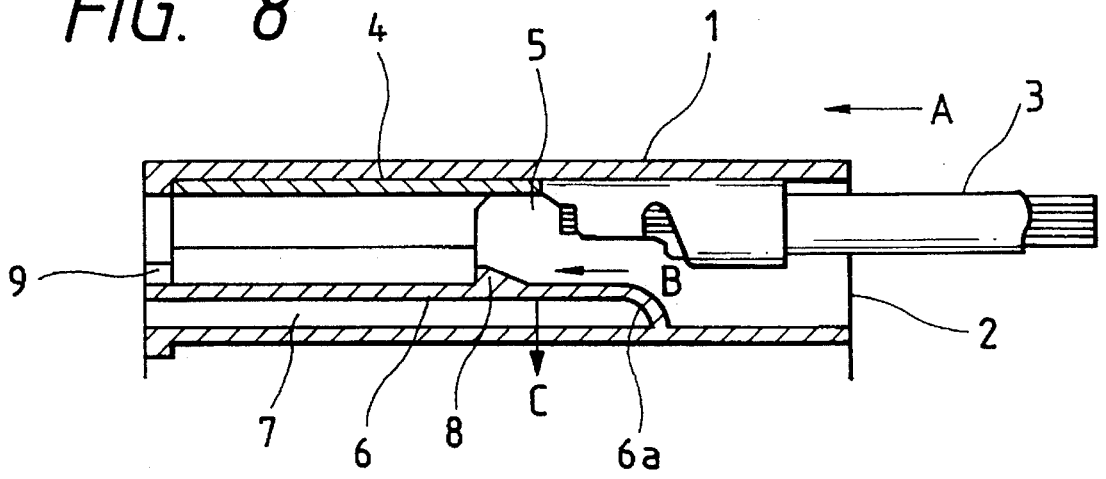
FIG. 8 is a cross-sectional view of a conventional connector housing.

FIG. 6 is a cross-sectional view of this embodiment, and FIG. 7 is a front-elevational view thereof.

A terminal insertion hole 52 is formed in a connector housing 50. The terminal insertion hole 52 is open at its rear end to provide a terminal insertion opening 52*a*, and its front end 52*b* is in communication with a connection opening 74 for connecting a mating terminal. Arrow A in the drawings indicates a terminal inserting direction. Terminal stoppers 58 for limiting the advance of a terminal 4 are formed at an inner edge portion of the connection opening 74, and an effective width of this opening 74 for allowing the insertion of the terminal 4 is indicated by H2 in FIG. 7.

An elastic lock piece 54 is provided at a lower side (in the drawings) of the terminal insertion hole 52, and is formed integrally with an inner wall of the terminal insertion hole 52. The elastic lock piece 54 has at its rear end a connecting portion 56 connected to an inner bottom wall of the terminal insertion hole 52, and extends forwardly in a cantilever manner so that its front end portion can be flexed in a plane extending along the direction A of insertion of the terminal 4.

The elastic lock piece 54 has a terminal engagement portion 60 for engagement with the terminal 4 which portion is formed on an upper surface of the front end portion of this elastic lock piece. A flexure-allowing space 62 for the elastic lock piece is provided beneath this elastic lock piece. The flexure-allowing space 62 is in communication with a release tool insertion opening 64 provided beneath the connection opening 74 formed in the front end of the connector housing 50 for connecting the mating terminal. Partition projections 66 are formed respectively on right and left inner surfaces of the terminal insertion hole 52, and are disposed respectively on opposite sides of the front end portion of the elastic lock piece 54. Distal ends of the partition projections 66 are disposed close to the distal end of the elastic lock piece 54, so that these partition projections serve to partition the connection opening 74 from the release tool insertion opening 64.

A retaining portion 70 for release purposes is formed on and projects from that surface of the elastic lock piece 54 facing the flexure-allowing space 62. A front end 82 of a release tool 80, inserted from the release tool insertion opening 64, is engageable with this retaining portion 70. This release-purpose retaining portion 70 is formed on a reverse side of the elastic lock piece 54 on which the terminal engagement portion 60 is provided, and that portion of the elastic lock piece having these portions is increased in thickness.

The terminal engagement portion 60 has a rear surface defined by a slanting surface 60*a* slanting downwardly rearwardly, and a front surface defined by a retaining surface 60*b* extending generally perpendicularly to the terminal inserting direction. The release-purpose retaining portion 70 has a slanting front surface 70*a* projecting progressively forwardly so as to facilitate the engagement of the front end 82 of the release tool 80 therewith. A width H2 of the connection opening 74 for connecting the mating terminal is smaller than a width H1 of the release tool insertion opening 64 so that the release tool will not erroneously be inserted into the connection opening 74.

For inserting the terminal 4, the terminal 4 is inserted into the terminal inserting opening 52*a* at the rear end of the connector housing 50. When the front end of the terminal 4 is brought into contact with the slanting surface 60*a* of the terminal engagement portion 60 during the insertion, the front end portion of the cantilever-type elastic lock piece 54 is pressed by the terminal 4 to be flexed toward the flexure-allowing space 62. When a step portion of the terminal 4 passes past the terminal engagement portion 60, the elastic lock piece 54 is restored, so that the terminal engagement portion 60 is engaged with the step portion of the terminal 4, thereby positioning and locking the terminal 4. In this case, since the elastic lock piece 54 is of the cantilever type, it can be easily flexed, and therefore the terminal 4 can be inserted easily.

For removing the terminal 4, the front end 82 of the release tool 80 is inserted into the flexure-allowing space 62 through the release tool insertion opening 64 at the front end of the connector housing, and is brought into engagement with the release-purpose retaining portion 70 projected from the lower surface of the elastic lock piece 54. Then, in this condition, the release tool 80 is pressed downwardly, using the partition projections 66 (disposed at the upper edge of the release tool insertion opening 64) as a fulcrum, so that the elastic lock piece 54 is easily flexed in a lock-releasing direction, thereby releasing the locked condition. Therefore, in this condition, the terminal 4 can be easily removed by withdrawing it.

In this case, since the release tool 80 is merely inserted into the flexure-allowing space 62, there is no chance that this release tool will contact the terminal 4 and the terminal engagement portion 60, and therefore there is no chance that the release tool will deform or damage these. And besides, since the flexure-allowing space 62 and the space for receiving the terminal 4 are partitioned by the partition projections 66, there is little chance that the release tool 80 will erroneously be inserted into the space holding the terminal 4. Moreover, since the release tool insertion opening 64 is provided at the front end face of the connector housing 50, the release tool 80 can be inserted without being interfered by a wire 3 extending from the rear end of the terminal 4.

As described above, in the first aspect of the invention, since the release-purpose retaining portion is formed on that surface of the elastic lock piece facing the flexure-allowing space, the elastic lock piece can be flexed so as to release the locked condition without contact of the release tool with the terminal and the terminal retaining portion. Therefore, the release tool will not deform or damage the terminal and the terminal engagement portion of the elastic lock piece.

In the second aspect of the invention, merely by inserting the release tool into the release tool insertion opening and then by angularly moving the release tool about the edge of this opening, the elastic lock piece can be easily flexed in the lock-releasing direction. Moreover, the release tool is inserted from the front side, the release operation can be carried out without being interfered by the wire extending rearwardly from the terminal. Therefore, the release operation can be carried out efficiently.

In the third aspect of the invention, since the release tool insertion opening is larger in size than the connection opening for connecting the mating terminal, the release tool will not be erroneously inserted into this connection opening, thus preventing the release tool from contacting the terminal.

In the fourth aspect of the invention, regardless of the size and shape of the release tool, an erroneous insertion of the release tool can be prevented.

What is claimed is:

1. A connector comprising:

a connector housing;

a terminal insertion hole formed in the connector housing;

a connection opening provided at a front end of the terminal insertion hole;

a terminal insertion opening provided at a rear end of the terminal insertion hole;

an elastic lock piece provided within the terminal insertion hole;

a terminal engagement portion formed on an upper surface of the elastic lock piece;

a flexure-allowing space provided beneath the elastic lock piece;

a release tool insertion opening in communication with the flexure-allowing space; and a release-purpose retaining portion formed on the elastic lock piece facing the flexure-allowing space.

2. A connector as claimed in claim 1, wherein the release tool insertion opening is provided beneath the connection opening.

3. A connector as claimed in claim 2, wherein a width of the release tool insertion opening is larger than a width of the connection opening.

4. A connector as claimed in claim 1, wherein the release-purpose retaining portion has a slanting front surface projecting progressively forwardly.

5. A connector as claimed in claim 1, wherein the release-purpose retaining portion is formed on a reverse side of the elastic lock piece on which the terminal engagement portion is disposed.

6. A connector as claimed in claim 1, wherein the release tool insertion opening and the terminal insertion hole are partitioned by a front end portion of the elastic lock piece.

7. A connector comprising:

a connector housing;

a terminal insertion hole formed in the connector housing;

a connection opening provided at a front end of the terminal insertion hole;

a terminal insertion opening provided at a rear end of the terminal insertion hole;

an elastic lock piece provided within the terminal insertion hole;

a terminal engagement portion formed on an upper surface of the elastic lock piece;

a flexure-allowing space provided beneath the elastic lock piece;

a release tool insertion opening in communication with the flexure-allowing space;

a release-purpose retaining portion formed on the elastic lock piece facing the flexure-allowing space; and partition projections formed on right and left inner surfaces of said terminal insertion hole, such that a tool inserted into said release tool insertion opening is prevented from extending into said terminal insertion opening.

8. A connector as claimed in claim 7, wherein said partition projections are disposed on opposite sides of a front end portion of said elastic lock piece.

9. A connector as claimed in claim 7, wherein the release tool insertion opening is provided beneath the connection opening.

10. A connector as claimed in claim 7, wherein a width of the release tool insertion opening is larger than a width of the connection opening.

11. A connector as claimed in claim 7, wherein the release-purpose retaining portion has a slanting front surface projecting progressively forwardly.

12. A connector as claimed in claim 7, wherein the release-purpose retaining portion is formed on a reverse side of the elastic lock piece on which the terminal engagement portion is disposed.

13. A connector as claimed in claim 7, wherein said partition projections partition the connection opening from the release tool insertion opening.

14. A connector as claimed in claim 7, wherein said partition projections extend substantially between a front end of said connection opening and a front end portion of said elastic lock piece.

15. A connector comprising:

a connector housing;

a terminal insertion hole formed in the connector housing;

a connection opening provided at a front end of the terminal insertion hole;

a terminal insertion opening provided at a rear end of the terminal insertion hole;

an elastic lock piece provided within the terminal insertion hole;

a terminal engagement portion formed on an upper surface of the elastic lock piece;

a flexure-allowing space provided beneath the elastic lock piece;

a release tool insertion opening communicated with the flexure-allowing space; and a release-purpose retaining portion formed on the elastic lock piece facing the flexure-allowing space, wherein said elastic lock piece partitions the connection opening from the release tool insertion opening.

16. A connector as claimed in claim 15, wherein the release tool insertion opening is provided beneath the connection opening.

17. A connector as claimed in claim 15, wherein a width of the release tool insertion opening is larger than a width of the connector opening.

18. A connector as claimed in claim 15, wherein the release-purpose retaining portion has a slanting front surface projecting progressively forwardly.

19. A connector as claimed in claim 14, wherein the release-purpose retaining portion is formed on a reverse side of the elastic lock piece on which the terminal engagement portion is disposed.

20. A connector comprising:

a connector housing;

a terminal insertion hole formed in the connector housing;

a connection opening provided at a front end of the terminal insertion hole;

a terminal insertion opening provided at a rear end of the terminal insertion hole;

an elastic lock piece provided within the terminal insertion hole;

a terminal engagement portion formed on an upper surface of the elastic lock piece;

a flexure-allowing space provided beneath the elastic lock piece;

a release tool insertion opening in communication with the flexure-allowing space;

a release-purpose retaining portion formed on the elastic lock piece facing the flexure-allowing space; and partition projections formed on right and left inner surfaces of said terminal insertion hole, such that a tool inserted into said release tool insertion opening is prevented from extending into said terminal insertion opening, wherein said partition projections are disposed on opposite sides of a front end portion of said elastic lock piece.

* * * * *